US005724961A

United States Patent [19]

Tistrand

[11] Patent Number: 5,724,961

[45] Date of Patent: Mar. 10, 1998

[54] VALVE ARRANGEMENT AND A BREATHING REGULATOR WHICH INCLUDES SUCH A VALVE ARRANGEMENT

[75] Inventor: Rolf Tistrand, Alingsås, Sweden

[73] Assignee: Poseidon Industri AB, Vastra Frolunda, Sweden

[21] Appl. No.: 624,622

[22] PCT Filed: Nov. 4, 1994

[86] PCT No.: PCT/SE94/01043

§ 371 Date: Jun. 26, 1996

§ 102(e) Date: Jun. 26, 1996

[87] PCT Pub. No.: WO95/12519

PCT Pub. Date: May 11, 1995

[30] Foreign Application Priority Data

Nov. 5, 1993 [SE] Sweden ..... 9303662

[51] Int. Cl.[6] ..... A62B 7/04

[52] U.S. Cl. ..... 128/205.24; 128/204.26; 128/200.29; 128/204.29

[58] Field of Search ..... 128/205.24, 204.26, 128/204.28, 200.29, 207.12, 204.29

[56] References Cited

U.S. PATENT DOCUMENTS 4,616,646 10/1986 Beaussant ..... 128/205.24
4,784,129 11/1988 Garraffa ..... 128/200.29

FOREIGN PATENT DOCUMENTS 014 290 8/1980 European Pat. Off. .
269 900 6/1988 European Pat. Off. .
974814 5/1961 Germany .

OTHER PUBLICATIONS

Excerpt from Manual for a Regulator "Oceanair" No. 2940.

*Primary Examiner*—Vincent Millin
*Assistant Examiner*—V. Srivastava
*Attorney, Agent, or Firm*—Sughrue, Mion, Zinn, Macpeak & Seas, PLLC

[57] ABSTRACT

A valve arrangement intended particularly, but not exclusively, for use with a breathing regulator (1) for underwater breathing apparatus includes an outlet side, an inlet (11) through which gas can pass to the outlet side from a source of gas having a pressure above atmospheric pressure, a movable valve means (12) which functions to close the gas inlet, and a servo device (21) for regulating the valve means. The servo device includes a servo housing (21) and two mutually joined arms (24, 26). The arms provide a lever effect whereby the supply of air can be controlled with great precision. The simplicity of the lever arrangement imparts a long useful life to the valve arrangement. A breathing regulator (1) which includes such a valve arrangement is preferably made essentially entirely from a plastic material.

10 Claims, 3 Drawing Sheets

VALVE ARRANGEMENT AND A BREATHING REGULATOR WHICH INCLUDES SUCH A VALVE ARRANGEMENT

TECHNICAL FIELD

The present invention relates to valve arrangements and then particularly, but not exclusively, to valves which are intended to control the flow of pressurized breathable gas to breathing regulators. The invention also relates to one such breathing regulator.

DESCRIPTION OF THE BACKGROUND ART

Valve arrangements for breathing regulators are known to the art, for instance from European Patent Specification 0 014 290 (Siebe Gorman). This patent specification discloses a valve arrangement which includes a housing, an inlet through which gas enters the housing from a gas source at a pressure above atmospheric pressure, a movable valve means which functions to close the gas inlet and which, in use, is activated by a force corresponding to the difference in pressure upstream and downstream of the inlet, and a diaphragm. The valve means preferably includes an arm and is connected to the diaphragm, and functions to open and close the inlet in response to the pressure prevailing in the housing.

The mechanism is highly sensitive and it is difficult to regulate the inlet air reliably.

Breathing regulator valve arrangements are also known by virtue of their use in a regulator which is marketed by Applicant (Poseidon) under the trademark Ocenair. This valve arrangement includes an elastomeric bladder which opens and closes the inlet in accordance with the difference in pressure of the gas located upstream of the inlet and the pressure of the gas located downstream thereof. A servo-valve coacts with the bladder to achieve the desired function.

This breathing regulator, however, is encumbered with certain drawbacks. For instance, the closing function of the bladder is not always reliable, and the servo-valve is constructed in a manner which causes the rocker valve included therein to move sideways, therewith subjecting the valve to uneven loads and also to extensive wear, while also shortening the useful life of the valve.

Furthermore, many of the components of the breathing regulators are made of metal, which is disadvantageous when diving, since the metal components are liable to freeze, therewith jeopardizing their function.

European Patent Specification EP-A1-0 269 900 teaches a valve arrangement of the kind described in the introduction, in which a valve element includes a hole through which air is able to flow. This air, however, is breathing air and is not used to control the actual valve means.

OBJECT OF THE INVENTION

The object of the present invention is to avoid the aforesaid drawbacks, by providing a breathing regulator valve arrangement which is able to regulate the air flow with great precision, which has a long useful life and which is insensitive to cold.

Another object of the invention is to provide a breathing regulator which includes an inventive valve arrangement.

SUMMARY OF THE INVENTION

The aforesaid objects are achieved with an inventive valve arrangement of the kind defined in the preamble of Claim 1 and characterized by the characteristic features set forth in the characterizing clause of said Claim, and also by a breathing regulator defined in Claim 7.

The inventive valve arrangement includes a lever-arm effect whereby air supply can be regulated or controlled with great precision. The simplicity of the lever-arm arrangement also imparts a long useful life to the valve arrangement.

According to the present invention, the whole of the breathing regulator can be made from a plastic material or from some other material which is insensitive to cold, therewith imparting a more reliable function to the regulator.

Other features of the invention are set forth in respective depending Claims.

BRIEF DESCRIPTION OF THE DRAWINGS

The invention will now be described in more detail with reference to exemplifying embodiments thereof and also with reference to the accompanying drawings, in which.

DESCRIPTION OF PREFERRED EMBODIMENTS

There will now be described a breathing regulator fitted with a valve arrangement in accordance with the invention, wherein similar components have been identified with similar reference signs in the different Figures of the drawings.

The Valve Construction

Figure 1:
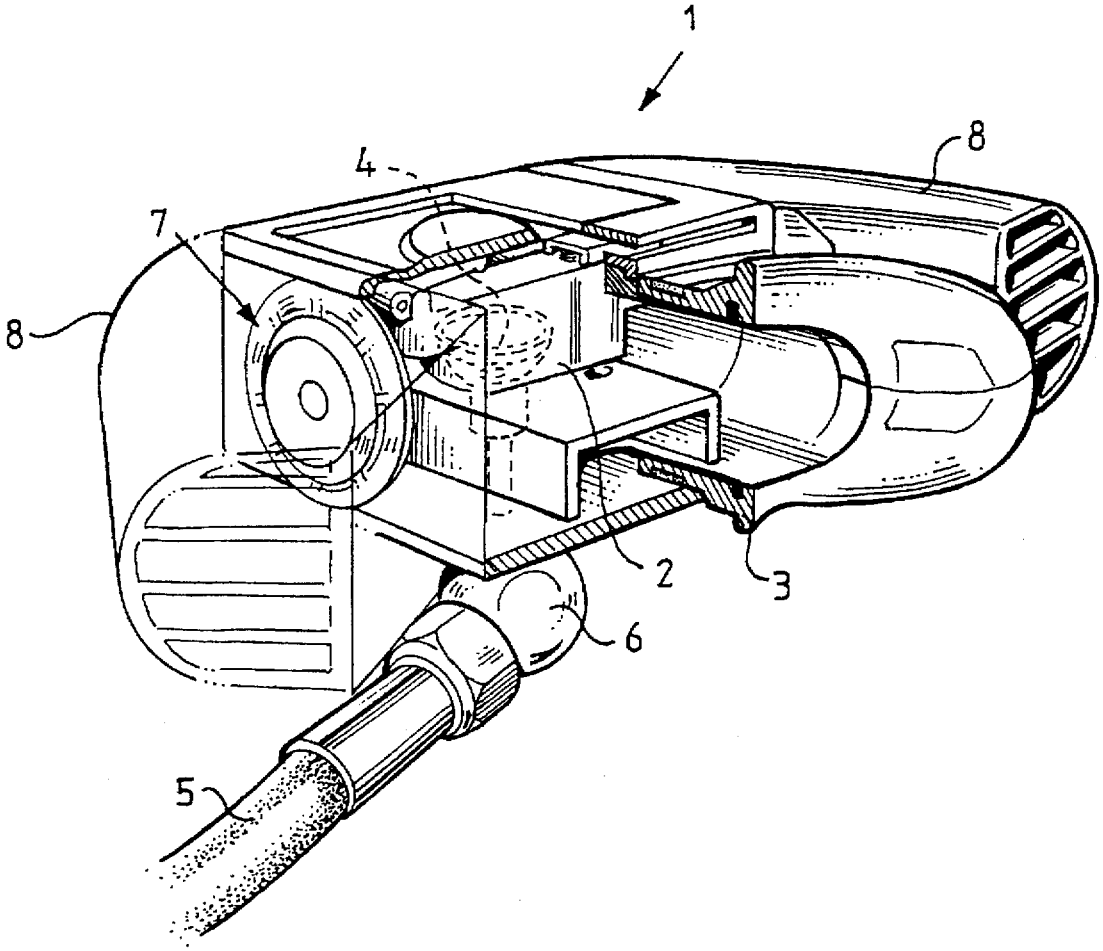
FIG. 1 illustrates an inventive breathing regulator, partly in section.

FIG. 1 illustrates the main parts of a breathing regulator 1 partly in section. These main parts include an air chamber 2 with which a nozzle 3, in the illustrated case a mouthpiece, connects and through which the user breathes. A dispensing valve 4, or so-called second stage demand valve, automatically controls the supply of air to the chamber in accordance with prevailing needs.

Also shown in FIG. 1 is an air hose 5 which is connected to an air container (not shown) which contains air at a primary pressure above atmospheric pressure and which is connected to the breathing regulator 1 by means of a swivel 6. A reduction valve or a so-called first stage valve (not shown) reduces the primary pressure (the container pressure) to a pressure in the order of 10 bars, wherein the breathing air is delivered to the chamber via the reduction valve and the dispensing valve 4.

Mounted in the chamber walls are two check valves 7 of known construction, of which only one is shown in FIG. 1. When an overpressure prevails in the chamber, for instance when exhaling, the chamber air will flow out through the check valves 7, via a respective diffuser 8, and out into the water.

Figure 2:
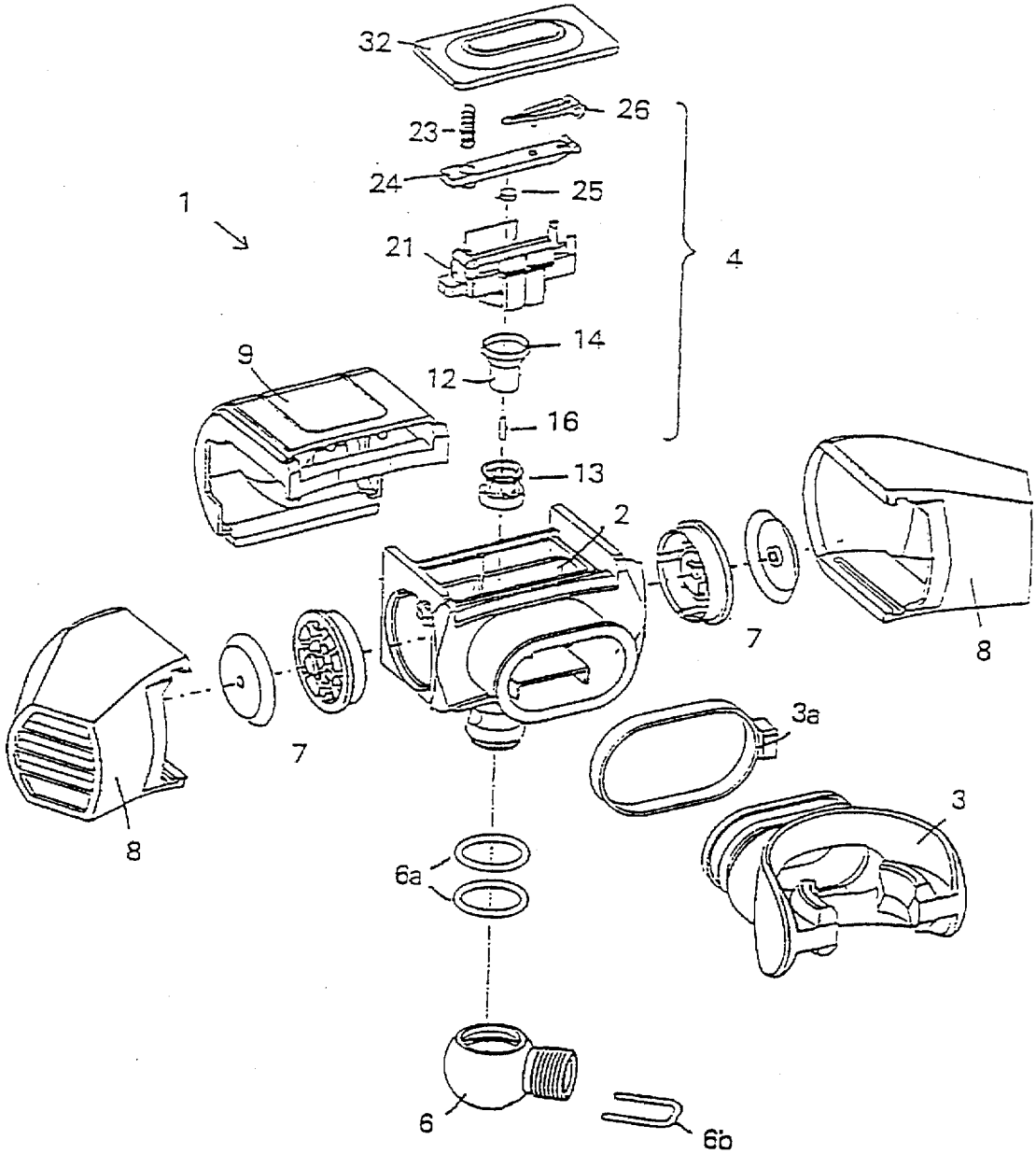
FIG. 2 is an exploded view of the regulator shown in FIG. 1.

FIG. 2 is an exploded view of the breathing regulator 1 illustrated in FIG. 1. It will be seen from FIG. 1 that the mouthpiece 3 is secured to the chamber by means of a locking scrap 3*a*, and that the swivel 6 is secured to the gas inlet by means of two O-rings 6*a* and a U-shaped locking member 6*b*. The chamber 2 is covered by a hood 9.

Figure 3A:
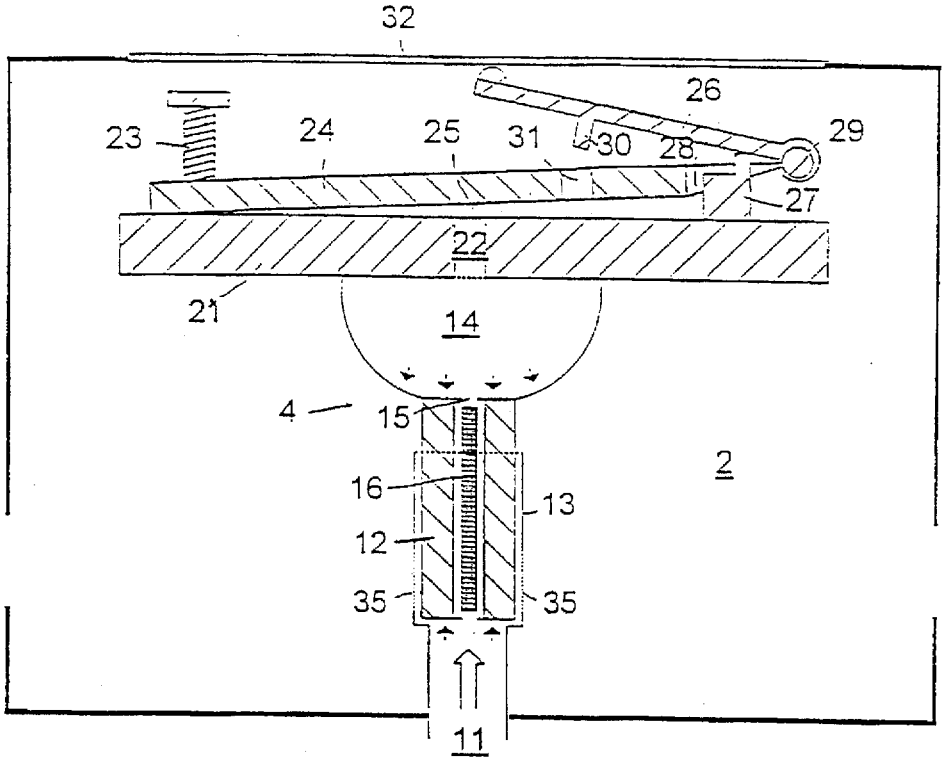
FIGS. 3*a* and 3*b* are schematic, principle cross-sectional views of a dispensing valve, or second stage demand valve, included in the regulator shown in FIGS. 1 and 2, and show the valve in a closed and an open state respectively.
Figure 3B:
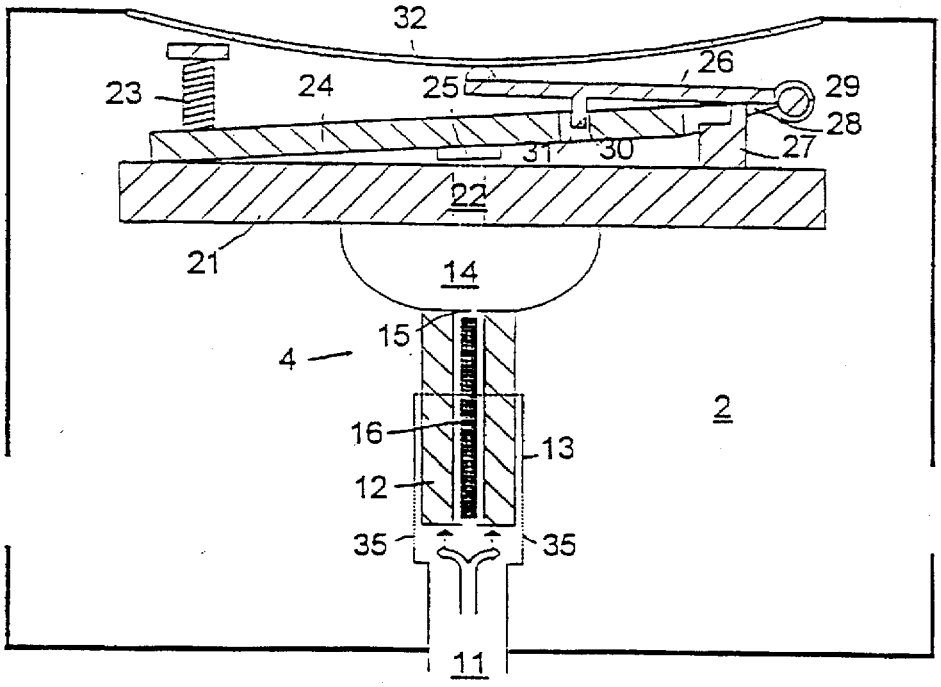

FIG. 2 illustrates more clearly the different components of the dispensing valve 4 which are also shown in cross-section in FIGS. 3*a* and 3*b*. Located between the gas inlet 11 and the chamber 2 is a movable valve means in the form of a piston 12 which functions to close the gas inlet 11. The piston 12 is controlled by a servo device and is mounted in a piston guide 13 which connects with the inlet and which at its bottom end includes openings 35 which open into the chamber 2. A bladder 14 made of elastomeric material, such as rubber, is sealingly connected to the end of the piston distal from the gas inlet. The piston also includes an axially through-penetrating hole 15 in which there is mounted an air filter 16. This through-penetrating hole thus connects the gas inlet with the bladder.

The bladder 14 is also sealingly connected to the servo device, which regulates piston movement. The servo device includes a servo housing 21 which includes a through-penetrating hole 22 which connects the bladder 14 to the chamber 2. This hole preferably has a diameter in the order of 0.2 mm. A spring 23 functions to press one end of a first arm or lifting arm 24 against the upper side of the servo housing. A rubber valve plate 25 is mounted about midway along the arm and, when in abutment with the servo housing, covers the through-penetrating hole 22.

The other end of the lifting arm 24, i.e. the end opposite to the spring-end, is connected pivotally to a second arm or lever 26. The lifting arm and the lever are able to define therebetween an angle which can vary between 0° and about 30°. The lever rests on a projection 27 on the servo housing, this projection passing through a first hole 28 provided in the lifting arm in the proximity of that end at which the arm is joined to the lever 26.

Provided on the underside of the lever is a guide pin 30 which coacts with a second hole 31 in the lifting arm.

The servo arrangement is positioned so that the end of the lever opposite to that at which the lever is joined to the lifting arm will be located roughly centrally above the through-penetrating hole 22 in the servo housing.

An elastomeric diaphragm 32, for instance a rubber diaphragm, is mounted in the roof of the chamber above the lever 26 and in close proximity thereof.

Valve Operation

FIG. 3*a* shows the dispensing valve 4 in a closed state, which is the state normally occupied by the valve until the user inhales. In this state of the valve, the arms 24 and 26 are in a position in which the hole 22 in the servo housing 21 is closed by the valve plate 25. Air entering the bladder 14 from the inlet 11 and via the filter 16 will therewith exert pressure on the piston, as indicated by the force arrows. The air will remain in the bladder whilst the through-penetrating hole in the servo housing is closed and whilst the pressure above the piston is greater than the pressure beneath the piston. The piston is therefore forced to a bottom end-position in which it closes the air passage from the inlet 11 into the chamber 2.

When inhaling through the mouthpiece, a subpressure is generated in the chamber 2. This subpressure causes the diaphragm 32 to be sucked down and act on the lever 26, which in turn causes one end of the lifting arm 24 to move upwards as a result of the lever effect thus generated. The through-penetrating hole 22 in the servo housing 21 is therewith opened, this opening being sealed-off by the valve plate 25 when the lever is not activated by the diaphragm 32, so as to allow the air in the bladder 14 to pass freely into the chamber 2. The piston 12 is forced up by the pressure exerted by the air which flows from the air tank into the inlet, therewith deforming the bladder 14 (see FIG. 3*b*). As the piston is forced up, the direct passage between inlet and chamber is opened and air from the air container is able to flow through the piston guide and through the chamber and into the mouthpiece. Air will flow along this path for as long as a subpressure prevails in the chamber, i.e. for as long as the user inhales.

The switching between the operational states of the valve effected through the lever-arm arrangement, enables the air supply to be regulated with great precision. Since the force exerted on the lever by the diaphragm acts essentially vertically downwards, no obliquely acting forces occur, in contradistinction to the known arrangements.

When the user ceases to inhale, the inflowing air will generate an overpressure in the chamber 2 and the diaphragm 32 will be forced upwards, whereupon the lever 26, and therewith also the lifting arm 24, will return to their respective original positions. In this operational state of the valve, the hole 22 in the servo housing 21 is again sealed by the valve plate 25 and the piston 12 is in its original bottom end-position.

As before mentioned, when the diver breathes out, the exhalation air travels from the mouthpiece 3 and through the chamber 2 and the check valves 7 and out into the water, via the diffusers 8. The dispensing valve is closed during the entire exhalation phase.

Any water present in the breathing regulator can be blown therefrom, by manually depressing the diaphragm 32. The passageway between the inlet 11 and the air chamber 2 will then be opened, similar to when inhaling, and air is able to pass freely through the chamber.

With the exception of the spring 23, the described breathing regulator can be made readily from a plastic material, which is an advantage since the working of the regulator is otherwise liable to be influenced by ice formations.

It will be understood that the invention is not restricted to the described and illustrated embodiment thereof and that modifications can be made within the scope of the following Claims. For instance, the movable valve arrangement may have some other shape, such as spherical, for instance. The illustrated and described valve arrangement can also be used in other applications, such as a safety valve, for instance.

I claim:

1. A valve arrangement intended particularly, but not exclusively, for underwater breathing apparatus (1), comprising an outlet side, an inlet (11) through which gas can pass to the outlet side from a gas source at a pressure above atmospheric pressure, a movable valve means (12) which is mounted for movement in a seating (13) and which functions to close the gas inlet, and a servo device (21) for regulating the valve means, characterized in that the movable valve means (12) includes an elastomeric bladder (14) at the end of the valve means opposite the inlet, and an axially extending through-penetrating hole (15) which connects the inlet (11) with the bladder interior; and in that the servo device includes a servo housing (21) to which the bladder (14) is sealingly connected and which includes a closable through-penetrating hole (22) for operating the valve arrangement, said hole (22) connecting the bladder interior with the outlet side (2);

wherein in a first operational state of the valve arrangement, the through-penetrating hole (22) in the servo housing (21) is closed and, as a result, the gas in the bladder exerts on the valve means (12) a pressure which exceeds the pressure acting on the valve means from the inlet side, therewith moving the valve means to a position in which said valve means (12) prevents gas from flowing from the gas inlet (11);

and in a second operational state of the valve arrangement, the through-penetrating hole (22) in the servo housing (21) is open and the pressure acting on the valve means (12) on the inlet side exceeds the pressure in the bladder (14), therewith moving the valve means to a position in which gas is permitted to flow from the gas inlet (11) through openings (35) provided in the valve seating (13), and out to the outlet side (2).

2. An arrangement according to claim 1, characterized in that the servo device includes a first arm (24) whose one end is pressed against the servo housing (21) by spring means;

a second arm (26) which is pivotally mounted at one end on a pivot shaft (29) located at the other end of said first arm (24), said one end of the second arm resting on a lever support (27);

a valve plate (25) which is mounted on the first arm (24) such as to close the through-penetrating hole (22) in the servo housing when said plate lies against said housing (21);

wherein in the first operational state of the valve arrangement said spring means moves the valve plate (25) into abutment with the servo housing (21) so as to close the through-penetrating hole (22) in said servo housing;

and in the second operational state of the arrangement, the other end of the second arm (26) is caused to move downwards by an operating means (32) so that one end of the second arm will be subjected to an upwardly directed translatory movement by virtue of the lever effect generated by the rotary axle (27) which translatory movement entrains the first arm (24) against the action of said spring means, wherein the valve plate (25) on the first arm is distanced from the through-penetrating hole (22) in the servo housing, therewith opening said hole.

3. An arrangement according to claim 2, characterized in that the first arm (24) includes a through-penetrating hole (28); and in that the lever support is comprised of a projection (27) on the servo housing (21), said projection passing through the through-penetrating hole (28) of the first arm (24).

4. An arrangement according to claim 1, characterized in that the valve means (12) has the form of a piston which moves in a piston guide (13) connected to the inlet (11).

5. An arrangement according to claim 2, characterized in that said spring means is a coil spring (23).

6. An arrangement according to claim 1, characterized in that the diameter of the through-penetrating hole (22) in the servo housing (21) is approximately 0.2 mm.

7. A regulator according to claim 2, characterized in that the operating means is a diaphragm (32) which forms an integral part of the chamber (2) and which when a subpressure prevails in the chamber is deformed such as to cause said other end of the second arm (26) to move downwards.

8. A regulator according to claim 7, characterized in that the diaphragm (23) can be deformed from outside the chamber (2).

9. A breathing regulator comprising a chamber (2), a mouthpiece (3, 3*a*, 3*b*) and at least one check valve (7), characterized by a valve arrangement which includes an outlet side, an inlet (11) through which gas can pass to the outlet side from a gas source at a pressure above atmospheric pressure, and a movable valve means (12) which is mounted for movement in a seating (13) and which functions to close the gas inlet, and a servo device (21) for regulating the valve means;

wherein the movable valve means (12) includes an elastomeric bladder (14) at the end of the valve means opposite the inlet, and an axially extending through-penetrating hole (15) which connects the inlet (11) with the bladder interior; and wherein the servo device includes a servo housing (21) to which the bladder (14) is sealingly connected and which includes a closable through-penetrating hole (22) for operating the valve arrangement, said hole connecting the bladder interior with the outlet side (2);

wherein in a first operational state of the valve arrangement, the through-penetrating hole (22) in the servo housing (21) is closed and, as a result, the gas present in the bladder exerts on the valve means (12) a pressure which exceeds the pressure acting on the valve means from the inlet side, therewith moving the valve means to a position in which the valve means (12) prevents gas from flowing from the gas inlet (11);

and wherein in a second operational state of the arrangement, the through-penetrating hole (22) in the servo housing (21) is open and the pressure acting on the valve means (12) on the inlet side exceeds the pressure in the bladder (14), therewith moving the valve means to a position in which gas is permitted to flow from the gas inlet (11) through openings (35) provided in the valve seating (13) and to the outlet side (2).

10. A regulator according to claim 9, characterized in that essentially the whole of the regulator is made from a plastic material.

* * * * *